US010257621B2

(12) United States Patent
Rosenkranz et al.

(10) Patent No.: US 10,257,621 B2
(45) Date of Patent: Apr. 9, 2019

(54) METHOD OF OPERATING A HEARING SYSTEM, AND HEARING SYSTEM

(71) Applicant: SIVANTOS PTE. LTD., Singapore (SG)

(72) Inventors: Tobias Daniel Rosenkranz, Erlangen (DE); Stefan Petrausch, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 15/872,151

(22) Filed: Jan. 16, 2018

(65) Prior Publication Data

US 2018/0206046 A1 Jul. 19, 2018

(30) Foreign Application Priority Data

Jan. 16, 2017 (DE) ..... 10 2017 200 597

(51) Int. Cl.
*H04R 1/40* (2006.01)
*H04R 3/00* (2006.01)
(Continued)

(52) U.S. Cl.
CPC ..... *H04R 25/505* (2013.01); *H04R 25/405* (2013.01); *H04R 25/407* (2013.01);
(Continued)

(58) Field of Classification Search
CPC .... H04R 25/405; H04R 25/407; H04R 25/50; H04R 25/505; H04R 25/552; H04R 25/554; H04R 2225/41; H04R 2225/43; H04R 2225/55; H04R 3/005; H04R 1/406; G10K 15/08; G10K 15/10; G10K 15/12
(Continued)

(56) References Cited

U.S. PATENT DOCUMENTS 4,536,887 A * 8/1985 Kaneda ..... H04R 3/005 381/356
4,953,219 A * 8/1990 Kasai ..... H04S 1/002 381/63
(Continued)

FOREIGN PATENT DOCUMENTS

WO 2016049403 A1 3/2016

OTHER PUBLICATIONS

Heinrich W. Loellmann, et al.; "Single-Channel Maximum-Likelihood T60 Estimation Exploiting Subband Information", ACE Challenge Workshop, a satellite event of iEEE-WASPAA 2015; Oct. 18-21, 2015.
(Continued)

*Primary Examiner* — Xu Mei
(74) *Attorney, Agent, or Firm* — Laurence A. Greenberg; Werner H. Stemer; Ralph E. Locher

(57) ABSTRACT

A method for operating a hearing system is defined, wherein a sound signal emanating from a sound source is measured by a plurality of microphones, which are fitted in different devices. Each of the microphones detects the sound signal and generates therefrom a microphone signal. The hearing system is binaural and two of the devices are each embodied as a hearing aid. For at least the two microphone signals from the microphones of the hearing aids there is determined an individual reverberation time in each case, and the individual reverberation times are combined in a dataset from which a general reverberation time is determined. An operating parameter of the hearing system is adjusted according to the general reverberation time. A corresponding hearing system is also defined.

17 Claims, 1 Drawing Sheet

(51) Int. Cl.
*G10K 15/08* (2006.01)
*H04R 25/00* (2006.01)

(52) U.S. Cl.
CPC ..... *H04R 25/50* (2013.01); *H04R 25/552* (2013.01); *H04R 25/554* (2013.01); *G10K 15/08* (2013.01); *H04R 1/406* (2013.01); *H04R 3/005* (2013.01); *H04R 2225/41* (2013.01); *H04R 2225/43* (2013.01); *H04R 2225/55* (2013.01)

(58) Field of Classification Search
USPC ..... 381/23.1, 312–321, 60, 63, 66, 72, 74, 381/91, 92, 122; 455/575.2
See application file for complete search history.

(56) References Cited

U.S. PATENT DOCUMENTS 9,467,790 B2 * 10/2016 Ojala ..... H04R 29/00
9,516,430 B2 * 12/2016 Jensen ..... H04R 25/552
2004/0213415 A1 * 10/2004 Rama ..... G01H 7/00 381/63
2004/0240676 A1 * 12/2004 Hashimoto ..... H04R 5/02 381/56
2007/0036365 A1 * 2/2007 Rohrseitz ..... H04R 25/70 381/60
2011/0255702 A1 * 10/2011 Jensen ..... G01H 7/00 381/66
2012/0148056 A1 6/2012 Pedersen
2012/0328112 A1 * 12/2012 Jeub ..... H04R 25/505 381/23.1
2015/0181355 A1 * 6/2015 Pedersen ..... H04R 25/407 381/313

OTHER PUBLICATIONS

Emanuel Anco Peter Habets: "Chapter 6: Late Reverberant Spectral Variance Estimation", Jun. 25, 2007 (Jun. 25, 2007), Technische Universiteit Eindhoven, XP055477322, ISBN: 978-90-38-61544-8 pp. 127-151, DOI:10.6100/IR627677.

* cited by examiner

METHOD OF OPERATING A HEARING SYSTEM, AND HEARING SYSTEM

CROSS-REFERENCE TO RELATED APPLICATION

This application claims the benefit, under 35 U.S.C. § 119, of German patent application DE 10 2017 200 597.1, filed Jan. 16, 2017; the prior application is herewith incorporated by reference in its entirety.

BACKGROUND OF THE INVENTION

Field of the Invention

The invention relates to a method for operating a hearing system and to a corresponding hearing system.

A hearing system comprises one hearing aid or two hearing aids worn by a user on, or in, the ear and used to amplify or modify sounds from the environment of the user. Hearing systems are normally worn by people with impaired hearing, i.e. people who are able to hear less well. In this case, a hearing aid uses a microphone to detect sounds from the environment as microphone signals, and amplifies these signals. The amplified sounds are then output as output signals via a loudspeaker, also known as an earpiece. Other modifications, for instance filtering or generally altering individual frequencies or frequency bands, are performed instead of, or in addition to, amplification.

The processing of the microphone signals to generate suitable output signals depends on a large number of factors. This fact is addressed by way of adjustable operating parameters which can be determined and adjusted suitably for the situation. The hearing system, usually each individual hearing aid, comprises a suitable control unit for this purpose. The optimum operating parameters depend not only on the individual hearing characteristics of the user but also on the environment in which the user is situated at a given point in time.

So-called "reverberation" or "reverb" presents a particular problem. Reverberation in particular relates to sounds that, owing to the nature of the environment, reach the user and hence the microphone in the hearing aid after a time delay and sometimes more than once because of reflection. Reverberation typically occurs in enclosed spaces and depends on their specific geometry and size. In particular, reverberation is diffuse and hence differs from the "direct sound," which reaches the microphone from a specific direction. The reverberation needs to be quantified in order to be able to adjust the operating parameters of a hearing system optimally. What is known as a reverberation time is usually measured for this purpose. This time describes the time decay of a sound. A specific reverberation time is known as the T60 time, or T60 for short. The publication "Single-Channel Maximum-Likelihood T60 Estimation Exploiting Subband Information", ACE Challenge Workshop, IEEE-WASPAA 2015, for example, describes a method for determining the reverberation time.

SUMMARY OF THE INVENTION

Against this background, it is an object of the invention to provide a hearing system and a method of operating the hearing system which overcome a variety of disadvantages of the heretofore-known devices and methods of this general type which provide a method that improves the determination of the reverberation time. It is a particular object to determine the reverberation time as quickly as possible and thereby to adapt the operating parameters of the hearing system as quickly as possible to the current environment. A further object is to provide for a corresponding hearing system.

With the foregoing and other objects in view there is provided, in accordance with the invention, a method for operating a hearing system, the method comprising:

providing a binaural hearing system and a plurality of devices, said devices including at least two hearing aids of said binaural hearing system, and providing a plurality of microphones fitted in different said devices;

measuring a sound signal emanating from a sound source with the plurality of microphones;

each of the microphones detecting the sound signal and generating therefrom a microphone signal;

determining an individual reverberation time for each of the at least two microphone signals from the microphones of the hearing aids;

combining the individual reverberation times in a dataset and determining therefrom a general reverberation time; and adjusting an operating parameter of the hearing system based on the general reverberation time.

The method is used to operate a hearing system. Such a hearing system usually comprises one hearing aid or two hearing aids, each worn by a user or wearer of the hearing system in, or on, the ear. In the present case, the hearing system is binaural and comprises two hearing aids. A sound signal, also referred to as the original signal, emanating from a sound source is measured by a plurality of microphones, wherein said microphones are fitted in different devices. The word "a" is not intended here in the sense of a quantifier; indeed preferably a plurality of sound signals are measured, more preferably even from a plurality of sound sources, in order to obtain as much data as possible. "Different devices" is understood to mean in particular those devices that are spatially separate from one another and normally are not fixed with respect to one another but instead as a general rule can move relative to one another. Examples of a device are a hearing aid of the hearing system, a smartphone, a phone, a television, a computer or the like. The essential feature is that the device comprises at least one microphone. In the present case there are at least two microphones installed, namely one in each of the hearing aids of the hearing system. Thus the two hearing aids are different devices.

Each of the microphones detects the sound signal and generates therefrom a microphone signal. In other words, the various microphones basically all detect the same sound signal and each individually generate a microphone signal. The sound signal usually emanates from a sound source, for instance a conversational partner or a loudspeaker. Said sound signal is time-limited, and therefore a plurality of sound signals can emanate from the sound source successively in time, and then a corresponding microphone receives a plurality of sound signals in particular successively in time, and generates from each of said sound signals a microphone signal. In principle there may also be a plurality of sound sources present that each emit one or more sound signals simultaneously and/or offset in time.

These sound signals are advantageously all captured by each of the microphones, and a multiplicity of microphone signals are then generated accordingly. The microphone signals constitute raw data here. A single microphone signal need not necessarily have a specific meaning in this case. Indeed the microphone signals are preferably "snippets", i.e. extracts or segments. The microphone signals, i.e. the raw data for subsequent analysis, are thus relatively short, in particular compared with individual spoken words. The microphone signals are each preferably at most 1 s long, more preferably at most 100 ms long.

In particular, generating microphone signals for subsequent analysis involves two dimensions: not only is the same sound signal captured by a plurality of microphones, but the same microphone also preferably captures a plurality of sound signals, e.g. sound signals that are offset in time and/or sound signals from different sound sources. This multiplicity of detected sound signals and of microphone signals generated therefrom subsequently forms the basis for particularly effective and precise determination of a general reverberation time in the specific environment.

For at least two of the microphone signals, preferably for each of the microphone signals, an individual reverberation time is determined in each case. Said at least two microphone signals in particular come from two different microphones, i.e. not from the same microphone. In the present case, the at least two microphone signals come from the two hearing aids of the hearing system. "Determining an individual reverberation time" is understood to mean in particular that the microphone signals are examined preferably independently of one another for the existence of a suitable event or feature for determining an individual reverberation time, in particular T60 time, and an individual reverberation time is then determined if such an event or feature exists. Determining the individual reverberation time hence involves initially a suitability check, i.e. a particular microphone signal is initially examined to ascertain whether an individual reverberation time can be determined from said signal. Preferably all the microphone signals undergo at least one such suitability check, i.e. examination. If the result of this examination is positive, i.e. an individual reverberation time can be determined from the microphone signal, then this time is actually determined. The microphone signal is examined, for example, for specific characteristic features in order to identify, for instance, transient or impulse-type sound signals, which are particularly suitable for determining the reverberation time. If the microphone signal comprises an appropriate event or feature, then an associated individual reverberation time is determined from the microphone signal. A particular individual reverberation time is thus the result of a specific sound signal that has been detected by one particular microphone of the microphones. In particular, a maximum of one individual reverberation time is determined from a single sound signal per microphone. The sound signal is time-limited in this case in particular in the respect that events or features that are suitable for determining another individual reverberation time are associated with a new, subsequent sound signal. Thus a particular sound signal and the corresponding microphone signal constitute in the context of determining the reverberation time in particular a smallest analyzable or evaluable segment.

The various microphones do not necessarily generate identical microphone signals from the same sound signal. In addition, different sound signals, in particular sound signals that are offset in time, sometimes vary in suitability for ascertaining features for estimating, i.e. determining, the reverberation time, or do not even contain any such features. For example, a decay in the sound level in response to a transient noise can be used to estimate the reverberation time. Depending on sound signal and positioning of the sound source relative to a particular microphone, it is possible that the corresponding microphone signal does not contain any suitable features and then an individual reverberation time cannot be determined from this signal, or that although features exist, they are not sufficient for the determination. Then although the associated sound signal is captured by the corresponding microphone, determining an individual reverberation time still does not produce a result. Thus in general, the individual reverberation time is determined in particular by examining a particular microphone signal for the existence of a feature for determining an individual reverberation time, and then, if it exists, the individual reverberation time is determined.

To determine the individual reverberation time, a suitable control unit processes a corresponding microphone signal. The same control unit need not necessarily be used for all the microphone signals. In fact in one variant, the individual reverberation times are determined by different control units. In this case, it is advantageous to use a common standard as basis, e.g. the T60 time. The individual reverberation times are combined in a dataset from which a general reverberation time is determined. A statistical method is advantageously used to determine the general reverberation time from the dataset of individual reverberation times, for instance as an average value or by means of a maximum likelihood algorithm. The publication "Single-Channel Maximum-Likelihood T60 Estimation Exploiting Subband Information", ACE Challenge Workshop, IEEE-WASPAA 2015, which was already mentioned in the introduction, describes a suitable method for determining the general reverberation time from a dataset containing a plurality of individual reverberation times. Unlike the present application, however, this method does not analyze and combine the microphone signals from a plurality of microphones of, in particular, different devices.

The method assumes in particular that all the microphones are in the same acoustic situation in which the same reverberation time prevails, at least approximately. This is because in particular in this case, the microphone signals can advantageously be used to determine the general reverberation time in a statistical analysis such as described above, for instance. Assuming that the same acoustic situation exists for the microphones can be a reasonable assumption in particular because of the spatial proximity of the different devices, which is advantageously ensured by the technical layout, e.g. connection distances between the devices, and/or ascertained by position finding e.g. by means of GPS.

An operating parameter of the hearing system is then adjusted according to the general reverberation time, i.e. the hearing aid is adjusted, is put into a specific operating mode or a specific operating program is loaded. In particular, the reverberation is reduced by adjusting the operating parameter, thereby improving the hearing comfort for the user of the hearing system.

In the present case, the hearing system is binaural, and two of the devices are each embodied as a hearing aid of the hearing system. In other words, the hearing system comprises two hearing aids, which usually can be worn, and advantageously actually are worn, on different sides of the head of the user. Irrespective of whether additional microphones of additional devices are used as well, the hearing system in this case comprises a first hearing aid having a first microphone and a second hearing aid having a second microphone. The two devices and hence the two microphones are here arranged on different sides of the head and thus cover different hemispheres. The at least two microphone signals, for each of which an individual reverberation time is determined, are thus microphone signals generated by the two different hearing aids of the hearing system.

Thus according to the method, an individual reverberation time is determined at least for each of the two microphone signals from the microphones of the hearing aids. In other words, the hearing system comprises two hearing aids, each of which comprises a microphone, wherein each of the microphones detects the sound signal and generates therefrom a microphone signal, with the result that two microphone signals are generated. Then an individual reverberation time is determined from each of the two microphone signals from the hearing aids. Depending on the embodiment, additional microphone signals from other devices are included here. In a first variant, the sensor network comprises only the two microphones of the two hearing aids of the hearing system; in a second variant, the sensor network further comprises additional microphones, which are accommodated in particular in other devices and specifically not in the hearing aids of the hearing system.

The combination of two microphones in a binaural hearing system in a combined sensor network ensures improved adjustment of the hearing system overall compared with individual operation of the hearing aids. This is evident in particular with regard to shadowing of individual microphones. As a result of shadowing, for instance by the user's head, which is positioned between the sound source and the microphone, the first hearing aid may not detect the sound signal, or may not detect it in full. Another microphone in the room, in particular a microphone of the second hearing aid on the other side of the head, does detect the sound signal in full, however. The reverberation time determined therefrom is then used advantageously to adjust the first hearing aid, for which otherwise optimum adjustment would not be possible. This concept can be applied to any combination of two or more devices that have a microphone and, as they are typically in different positions in the room, may not detect the same sound signal because of shadowing.

A particular advantage in using, as described above, the two hearing aids of a binaural hearing system compared with a combination with any other devices, is that the relative position of the two devices with respect to one another is known with a particularly high level of certainty. Namely, the arrangement on different sides of the head means that the two hearing aids are arranged at a fixed separation, which although may vary slightly from user to user, on average equals about 20 cm. In comparison, there is a greater uncertainty associated with the position of other devices such as e.g. smartphone, phone installation, television or computer relative to one another or relative to the hearing system, and this position is also subject to far larger variations. The aforementioned assumption that the various microphones are in the same acoustic situation thus applies particularly to the two hearing aids of a binaural hearing system but cannot be taken as a definite given for other devices, e.g. if a television is located in an adjacent room or if a smartphone is located in a pocket.

In particular, the invention is based primarily on the observation that the measurement of the reverberation time tends to be error-prone and that the quality of the measurement is also heavily dependent on the environment. In principle, in order to obtain an average value for the reverberation time that is as useful as possible, the microphone of a hearing aid can be used to determine the reverberation time repeatedly and over a prolonged time period of typically several minutes. This, however, results in a correspondingly long adaptation phase for the hearing system, during which the adjustment of the hearing system may not be optimum. In the present case, said disadvantage is reduced by a drastic cut in the time needed to determine the reverberation time. This is facilitated by combining data from a plurality of microphones located in different devices and the shared analysis of this data, more precisely of the individual reverberation times. A central idea of the invention here is in particular to use as large a sensor network as possible, i.e. as many microphones as possible, in order to obtain as many microphone signals, and hence as much raw data, as possible, and to determine therefrom as many individual reverberation times as possible, as quickly as possible. These reverberation times are then processed in order to adjust at least one operating parameter of the hearing system optimally and particularly quickly.

It has been identified in this case that instead of, or in addition to, the microphone of a hearing aid, other microphones, specifically the microphones of the individual hearing aids of a binaural hearing system, can also be used advantageously for the object described above. In a room there are often additionally a multiplicity of additional microphones, above all in telephones, mobile phones, in particular smartphones, also in television sets, computers, video cameras and similar devices, but also in the hearing aids of other people who are in the same room. An essential advantage of the invention is then in particular that the microphones of such devices, i.e. microphones external to a particular hearing system, can also be used, and advantageously actually are used, to determine the reverberation time and hence used to adjust the hearing system. The microphones used form a sensor network, more specifically a microphone network, that facilitates particularly rapid determination of the reverberation time, because far more sources for microphone signals are available and used compared with the individual hearing aid of the hearing system. This is significant in particular because in order to determine the reverberation time, impulse-type sound signals are preferably used, which are usually infrequent compared with other, e.g. continuous, sound signals. By employing a plurality of microphones, the same sound signal is used more effectively to determine the reverberation time. In the present case, the sensor network comprises at least two microphones, which are arranged in different hearing aids of the binaural hearing system of a single user and which, during operation, are located on different sides of the head of the user. In this embodiment, the two microphones advantageously cover both hemispheres, i.e. sides of the head of the user. Advantageously, however, the sensor network comprises yet more microphones.

It is also evident that in principle it is also possible to adjust the hearing system entirely on the basis of externally determined reverberation times. In this case, the hearing system itself does not need to determine any reverberation times but draws entirely on a dataset that is, or was, formed from microphone signals from other microphones. It is advantageous, however, to use the microphones of the hearing system, more specifically the hearing aids of the hearing system, because these microphones are typically significantly better suited to capturing sound signals than microphones of other devices.

In an advantageous embodiment, at least two of the microphones are arranged in different hearing systems. In other words, the microphones belong to different hearing systems, which are used by different users. In this embodiment, the user benefits from the collected data, more precisely the microphone signals, from another user. The two hearing systems are advantageously connected together for data transfer, e.g. via a wireless connection. The hearing systems are connected to one another either directly, i.e. without an intermediary, or indirectly via an additional device, i.e. via an auxiliary device.

In another advantageous embodiment, one of the microphones is located in a hearing aid and another of the microphones in a smartphone. A microphone of the smartphone is thereby advantageously used to determine the general reverberation time. Using a smartphone is particularly advantageous because such a device usually has the capability to be positioned anywhere, and, for instance, can be placed centrally in a room in order to capture optimally as many sound signals as possible. It may thereby be possible to detect sound signals that the hearing system itself does not detect or detects only poorly. The hearing system is advantageously connected to the smartphone for the purpose of data transfer.

In a suitable embodiment, the processes of determining the individual reverberation time, combining into a dataset and determining the general reverberation time are all performed by a control unit of the hearing system. In a particularly preferred embodiment, the microphone signals are in this case combined into a raw dataset and saved. The raw dataset is not necessarily saved in the hearing system, but instead in this case an external memory is particularly suitable, e.g. as part of a smartphone, of a server or of a Cloud service. In other words, the raw data is saved externally in relation to the hearing system. The hearing system, more precisely the control unit thereof, then accesses the raw data and determines from this data as far as possible first the individual reverberation time in each case and then the general reverberation type. This embodiment is based on the consideration that the hearing system at least, but not necessarily other devices, is suitably designed to analyze the microphone signals. Thus initially only the raw data is collected and then provided to the hearing system. In addition, the microphone signals are also available to a plurality of users by virtue of the external memory.

This complete evaluation and analysis of the raw data by the hearing system itself is not mandatory, however. Thus in one variant, said three method steps are not performed by the same device. Indeed, allocating to different devices is also advantageous.

In an advantageous embodiment, the individual reverberation times are combined into a dataset on an external auxiliary device. In this embodiment, the individual reverberation times of the microphone signals from a corresponding microphone are preferably determined first by that device in which the microphone is fitted. Specifically, the microphone signals detected by a microphone of the hearing system in particular are also analyzed by a control unit of the corresponding hearing aid in which the microphone is fitted. In the case of a smartphone, the smartphone itself determines the individual reverberation times for the microphone signals from the smartphone microphone. Thus in general, the individual reverberation time is determined as locally as possible. This significantly reduces the amount of data that subsequently must be transferred in order to form the dataset, because rather than transferring the entire microphone signal, only the individual reverberation time determined therefrom is transferred. The individual reverberation times are transmitted to the auxiliary device, e.g. via a wireless connection, and combined there into the dataset. In one variant, however, the microphone signals are transferred to the auxiliary device and the individual reverberation times are not determined until there. Thus the microphone signals are first combined into a raw dataset on the auxiliary device, and then the dataset containing the individual reverberation times is also generated on the auxiliary device by the auxiliary device analyzing the raw dataset. In other words, the dataset is advantageously also analyzed on the auxiliary device. In addition, the auxiliary device advantageously determines from the dataset also the general reverberation time, which is then transmitted to the hearing system. One advantage of this embodiment in particular is that the auxiliary device typically has more processing power and hence is more efficient in analyzing the dataset than the hearing system, for instance. Thus the auxiliary device serves to relocate the computationally intensive determination of the reverberation time. Furthermore, this also advantageously reduces the power consumption of the hearing system.

Advantageously, the microphone signals generally, and the individual reverberation times specifically, including from devices other than in the hearing system, are recorded on the auxiliary device in the corresponding raw dataset or dataset, so that the general reverberation time fed back to the hearing system is not derived solely from those individual reverberation times that were determined solely by the hearing system. Instead, the hearing system also benefits from reverberation times that were determined by other devices.

In a preferred embodiment, the auxiliary device is a smartphone, i.e. in general notably a mobile device. A smartphone is characterized by a high processing power and by a high energy capacity, at least in comparison with a hearing aid, and thus is particularly suitable as a processing unit. A smartphone also has suitable connection facilities for data communication with the hearing system, for instance via a Bluetooth interface. The smartphone is advantageously also connected to other devices via a suitable data communication connection in order to receive microphone signals or individual reverberation times from these devices and to form as large a dataset as possible. Many users of hearing aids also already own a smartphone, and therefore there is no need to procure an additional auxiliary device. A smartphone is also usually located in the spatial proximity of the user and hence is practically ready for use in every aspect.

In another preferred embodiment, the auxiliary device is a server that is in particular stationary, i.e. fixed, on which the dataset is saved and in particular also analyzed. In this embodiment, the auxiliary device advantageously constitutes a central analysis unit, which has sufficient processing power to analyze the dataset, and moreover combines the microphone signals and/or individual reverberation times, i.e. in general data, from a multiplicity of devices. The combining is preferably performed via the Internet, i.e. as part of a Cloud-based solution. The server then gathers the data from the various devices and brings this data together in a centralized manner so as to ensure particularly fast and reliable determination of the general reverberation time and of the adjustment to the hearing system. A crowd-based analysis is advantageously also implemented by the server by combining the data from a plurality of hearing systems of different users, so that the users benefit amongst each other from the data from each of the other users.

In a particularly advantageous embodiment, the two aforementioned concepts using smartphone and server are combined, resulting in the use of two auxiliary devices, namely a smartphone and a server. The smartphone then advantageously constitutes a connecting link between the hearing system and the server. For this purpose, the smartphone is connected, for example via a Bluetooth connection, to the hearing system, more precisely to the hearing aid or hearing aids thereof, and receives microphone signals detected by said hearing aid and/or individual reverberation times determined from these signals. In particular a local dataset of individual reverberation times is then created on the smartphone. The smartphone is also connected to the server, advantageously via the Internet, in order to retrieve from said server additional individual reverberation times or a general reverberation time and/or in order to transmit the local dataset to the server.

Overall, a multiplicity of embodiments are possible and suitable because of the allocation of the method steps to the different devices and auxiliary devices and because of the different data. In general, using a smartphone constitutes a personal solution for the user, whereas using a server constitutes a crowd solution. In combination, it is then possible for a user generally to access the server, or alternatively, e.g. when no Internet connection is possible, to fall back on just the personal solution.

In general, notably the following configurations are suitable:

- A hearing system having two hearing aids, each of which determines individual reverberation times, with the dataset being formed on one of the hearing aids. The two hearing aids are connected to a connection device, preferably wirelessly.
- A hearing system having one hearing aid or two hearing aids connected to an auxiliary device, preferably wirelessly. The auxiliary device is in particular a remote control unit for the hearing system, which unit preferably comprises a microphone, the microphone signals from which are also used to determine the general reverberation time.
- A hearing system having two hearing aids and, connected to the hearing system either directly or indirectly via an auxiliary device as mentioned above, a smartphone. Also the smartphone comprises a microphone, the microphone signals from which are used to determine the general reverberation time.
- A plurality of hearing systems of different people in the same room. The hearing systems are connected to one another for the purpose of data transfer either directly and/or via one or more smartphones. The data from the people is interchanged and added to a dataset local to each person. Alternatively or additionally, the smartphones are connected to a server on which a shared dataset is stored.
- A hearing system having at least one hearing aid connected to a smartphone. The smartphone provides a location stamp, i.e. a piece of geographical information, to the microphone signals from the hearing aid or to the individual reverberation times derived therefrom or to a general reverberation time derived therefrom. The smartphone combines the current data with earlier data that has the same location stamp.
- An aforementioned configuration, in which the smartphone is connected to a server in order both to send data to said server and to receive data, in particular also from other people.
- A combination of all or some of the aforementioned configurations.

In an advantageous development, the general reverberation time is determined by device-dependent weighting of the data for the dataset, i.e. of the microphone signals or of the individual reverberation times. This is based in particular on the consideration that different devices may vary in suitability for providing the relevant data. Moreover, it is possible that a device is positioned in a less relevant position. In general, by means of the device-dependent weighting, different levels of consideration are given to the data from different devices when determining the general reverberation time. For example, the microphones of hearing aids are weighted more heavily than a microphone of a telephone, because the former may have a larger bandwidth and allow the reverberation time to be determined more reliably. Hence weighting is advantageously based on the type of the device. Consequently, this development is particularly suitable for an embodiment in which, in addition to the hearing aids of the hearing system, extra devices are present, the microphones of which are integrated with the microphones of the hearing aids in a shared sensor network.

Alternatively or additionally, the general reverberation time is advantageously determined by owner-dependent weighting of the data, i.e. of the microphone signals or of the individual reverberation times. It is hence advantageously possible to give preference to using the data generated by the user's own hearing system, and lower priority to using external data, i.e. data of external origin. This is advantageous especially when the origin, the quality or the accuracy of the external data is unknown.

Alternatively or additionally, the general reverberation time is advantageously determined by time-dependent weighting of the data, i.e. of the microphone signals or of the individual reverberation times. This is based in particular on the consideration that at different times the user is located in different rooms or that a room changes over time, with the result that the reverberation time also varies over time. By virtue of the time-dependent weighting of the data, only the data relevant at the given point in time is then advantageously used to determine the reverberation time. "Time-dependent" is understood to mean here in particular that the data is weighted at a specific point in time according to an acquisition time in relation to this specific point in time. In other words, each microphone signal is generated at a corresponding acquisition time, which is saved with the microphone signal. At a specific, in particular current, point in time, this point in time is compared with the acquisition time and a decision then made as to how heavily to weight the associated microphone signal or the individual reverberation time derived therefrom. For example, the reverberation in a room differs at night compared with during the day by curtains being drawn closed. At night, data that has an acquisition time during the night is weighted more heavily than other data.

Alternatively or additionally, the microphone signals or the individual reverberation times, i.e. generally the data, are suitably provided with location information, also referred to as position information. This is understood to mean in particular that the microphone signals or the individual reverberation times are combined according to location into a raw dataset or into a dataset or into a plurality of raw datasets or datasets or a combination thereof. This embodiment in particular has the advantage that the hearing system is then supplied according to location with data relevant to that location and optimally adjusted according to location. Different rooms are then preferably allocated different raw datasets or datasets or both, each of which datasets advantageously contains only that data that has been acquired in the corresponding room, i.e. at the corresponding location. Thus overall, notably all the microphone signals or individual reverberation times in a specific area are brought together into a single, in particular location-dependent, raw dataset or dataset. The embodiment in which the microphone signals, i.e. the raw data, is provided directly with location information, has the advantage that each hearing system can then itself perform at a given location the analysis of the raw data and the determination of the general reverberation time, and in particular can do so individually or even according to user. Conversely, providing individual reverberation times with location information saves corresponding processing power in the hearing system.

In order to allocate or select according to location the data to be used, said data is provided with location information, i.e. with a location stamp, for instance by means of GPS. The location information then preferably consists of GPS coordinates. In particular, each microphone signal or each individual reverberation time is provided with its own position information. In this case, the same location information is advantageously used for a plurality of microphone signals or reverberation times at the same location or at sufficiently identical locations.

For the sake of simplicity, only embodiments that use the individual reverberation times are mentioned below. In a suitable variant, however, the microphone signals are used directly instead of the individual reverberation times or in addition thereto. The statements hence apply analogously also to embodiments and developments in which the microphone signals are used directly instead of, or in addition to, the individual reverberation times, and in particular if there exists a raw dataset of microphone signals instead of, or in addition to, a dataset of individual reverberation times.

The provision of location information, i.e. labeling an individual reverberation time with location information, is preferably performed in a smartphone, which usually already has a GPS receiver. Alternatively or additionally, the hearing system comprises a GPS receiver and provides a location stamp to the microphone signals or the individual reverberation times determined therefrom. Alternatively, only the dataset is provided with a location stamp, and the data is then added according to location directly to the associated dataset.

Advantageously, all or some of the aforementioned device-dependent, owner-dependent, time-dependent and location-dependent weightings of the data are combined with one another in order to obtain a particularly optimum selection and to determine the general reverberation time in a correspondingly optimum manner.

In a particularly advantageous embodiment, the microphone signals or the individual reverberation times for a location are saved, and are used to determine the general reverberation time when a return is made later to exactly that location. This is based in particular on the idea that individual reverberation times once determined at a specific location can be used advantageously when the location is visited again later, in particular in addition to newly determined individual reverberation times. Taking into account the previously determined, i.e. older, reverberation times, the hearing system is then optimally adjusted significantly more quickly than if only newly determined individual reverberation times were available.

The individual reverberation times are each advantageously provided with location information for this purpose, as described above, so that the hearing system or another device compares the current location of the user with the location information, and on there being a sufficient match, additionally draws on the corresponding saved individual reverberation times to determine the general reverberation time. In one variant, if, for instance, it is not possible to determine additional individual reverberation times, recourse is made at least to the already saved individual reverberation times in order to determine the general reverberation time. For example, the location is a specific room. The subsequent return to the location can in principle lie at any length of time after the prior arrival at, or departure from, the location. The individual reverberation times are stored for a correspondingly long period. The location may be visited regularly, for instance a restaurant or a workplace may be visited daily, with the exclusion of certain days, for instance weekends. Additionally or alternatively, the location may be visited sporadically, for instance a concert hall may be visited at an interval of up to several weeks, months or years. Even shorter intervals, for instance one or more minutes, hours or days, are possible.

In particular in the context of location-dependent weighting, but also in general, it is advantageous to add additional individual reverberation times to the dataset. Hence in an advantageous embodiment, a calibration measurement is used to measure additional reverberation times, or at least one additional reverberation time, which are added to the dataset. In particular, microphones of the highest possible quality are used for the calibration measurement, in order to obtain as good a measurement result as possible. Thus measurements of the reverberation time are made in particular in advance for a given room or location, and the data obtained in the process saved in order to be available later to a user. In particular, this dispenses with any adaptation time for the hearing system even when the room is entered for the first time, because data already exists for this room. For instance, the calibration measurement is performed in a theatre auditorium by the owner of the auditorium. The additional reverberation time is advantageously provided online and then retrieved by the server or by the smartphone or directly by the hearing system. The above statements relating to the use of saved individual reverberation times for subsequent return to the same location apply analogously also to using additional data from a calibration measurement, and vice versa.

In an advantageous embodiment, the microphone signals or the individual reverberation times are each provided with a timestamp, in particular the aforementioned acquisition time, and the general reverberation time is determined by taking into account only those microphone signals or individual reverberation times having timestamps that date no further back than a predetermined maximum period. In particular this results in the advantage that data dated further back, which is probably unusable, is effectively forgotten and at least not taken into account. Said period defines the time interval in the past taken into account as a maximum. For instance, the period equals one or more hours, days, weeks or months. In one development, the period is selected differently according to location in order to take optimum account of environments that change at different rates.

A hearing system according to the invention is designed for operation by a method as described above. The hearing system is a binaural hearing system and comprises two hearing aids, each of which comprises at least one microphone for the purpose of detecting a sound signal and generating a microphone signal from the sound signal. The hearing system also comprises a control unit, which is designed such that the hearing system is adjusted according to a general reverberation time. In particular, the control unit is designed such that a method as described above is implemented. The general reverberation time is determined either locally by the hearing system itself or externally by an auxiliary device, e.g. a smartphone or server. Depending on the embodiment, the hearing system comprises a connection device for the purpose of data communication in order to exchange data, if applicable, with an auxiliary device, as described above in connection with the method.

Other features which are considered as characteristic for the invention are set forth in the appended claims.

Although the invention is illustrated and described herein as embodied in a method of operating a hearing system and hearing system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
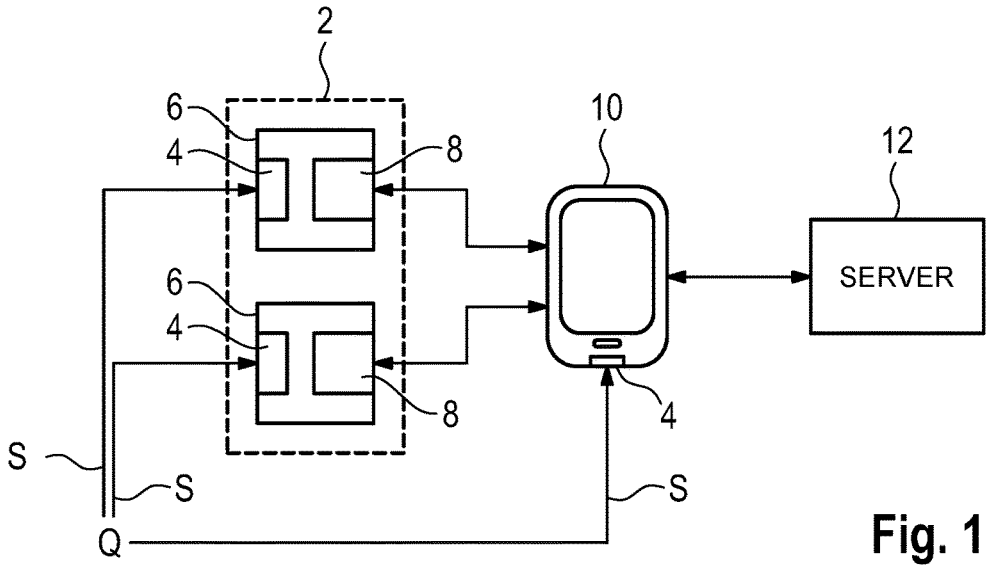
FIG. 1 shows schematically a hearing system and additional devices.

Referring now to the figures of the drawing in detail and first, particularly, to FIG. 1 thereof, there is shown one of a plurality of possible configurations, in which a hearing system 2 is optimally adjusted by means of a plurality of microphones 4. The hearing system 2 has a binaural design and comprises two hearing aids 6, each of which comprises a microphone 4 and a control unit 8. Both hearing aids 6 are connected to a smart device, such as a smartphone 10, for instance via a Bluetooth connection. The smartphone 10 likewise comprises a microphone 4, although that microphone does not necessarily have the same design as the microphones 4 of the hearing system 2. The smartphone 10 is in turn connected to a server 12, e.g. via the Internet. The smartphone 10 and the server 12 are each an auxiliary device. The hearing aids 6, the smartphone 10 and the server 12 are each also generally denoted as a device.

Figure 2:
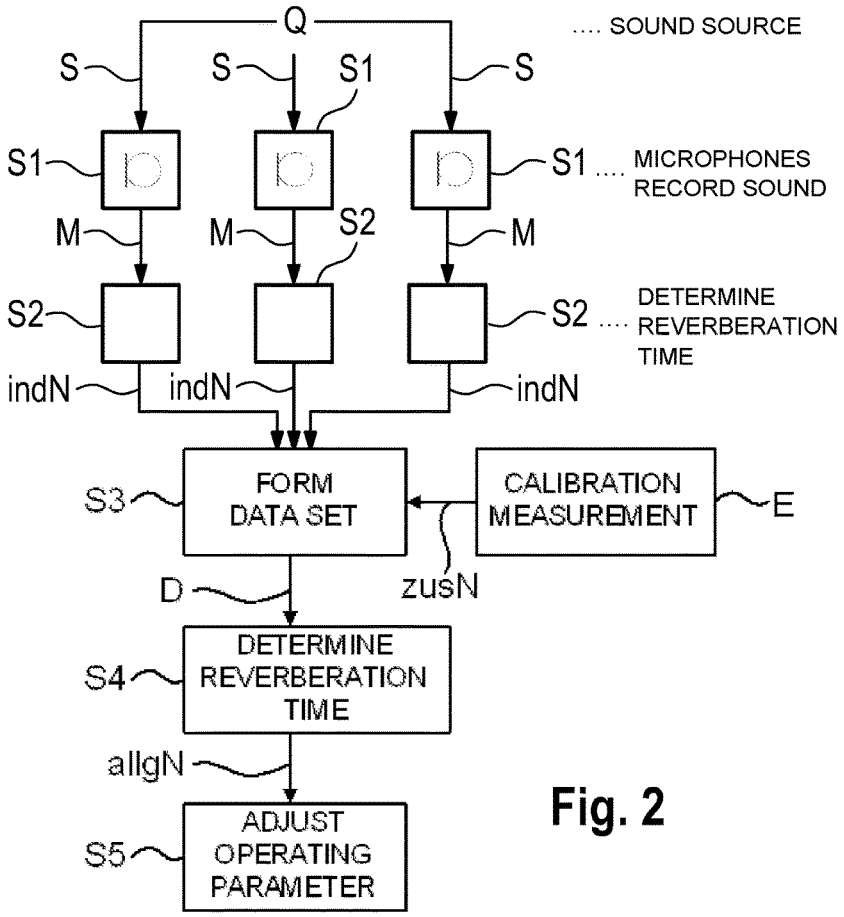
FIG. 2 is a schematic flow diagram illustrating a method for operating the hearing system.

A method for operating the hearing system 2 is explained in greater detail below in conjunction with the flow diagram shown in FIG. 2. A sound signal S emanates from a sound source Q and, in a step S1, is measured by a plurality of microphones 4. The microphones 4 are fitted in different devices 6, 10, e.g. in a hearing aid 6, a smartphone 10, a telephone, a television or a computer. In principle it is also possible here for there to be a plurality of microphones 4 fitted in a single apparatus. Each of the microphones 4 detects the sound signal S and generates therefrom a microphone signal M in step S1. Then in a step S2, an individual reverberation time indN is determined for each of the microphone signals M, but at least for the microphone signals M from the microphones 4 of the hearing aids 6. In a step S3, the individual reverberation times indN are combined in a dataset D, from which in turn, in a step S4, a general reverberation time allgN is determined.

Preferably, the individual reverberation time indN of a particular microphone 4 is determined by that device 6, 10 in which the microphone 4 is fitted. This reduces the amount of data to be transferred. In the example of FIG. 1, the hearing aids 6 and the smartphone 10 each detect the sound signal S, generate microphone signals M and determine from these signals, in particular locally, an individual reverberation time indN. All the individual reverberation times indN are transferred to the smartphone 10 and combined there into the dataset D, from which the general reverberation time allgN is then determined, preferably using a statistical method. Then in a step S5, an operating parameter of the hearing system 2 is adjusted according to the general reverberation time allgN. In the example of FIG. 1, the general reverberation time allgN is transferred for this purpose to the hearing system 2, in particular to the control units 8.

FIG. 1 also shows a server 12 as an auxiliary device. This performs various functions depending on the embodiment. In one variant, the dataset D is transferred to the server 12, where the general reverberation time allgN is then determined and returned to the hearing system 2 via the smartphone 10. In this case, the smartphone 10 does not need to perform any analysis itself. The dataset D, however, can also be analyzed as it were redundantly on both auxiliary devices 10, 12. Preferably, however, the server 12 is used as part of a Cloud-based solution for bringing together data, i.e. microphone signals M and/or various individual reverberation times indN from a multiplicity of devices. In this case, the server 12 gathers the data M, indN from the various devices and brings this data together in a centralized manner, ensuring that the general reverberation time allgN and the adjustment of the hearing system 2 are determined particularly quickly and reliably. In one variant, a crowd-based analysis is implemented in particular, in which the data M, indN from a plurality of hearing systems 2 of different users is brought together in order that the users can benefit amongst one another from the data M, indN from each of the other users.

The data M, indN in particular is weighted, so that different levels of consideration are given to different data M, indN in determining the general reverberation time allgN. Weighting is performed in particular on a device-dependent, time-dependent, location-dependent or owner-dependent basis. For this purpose, the data M, indN is provided with suitable stamps or metatags, which are read during the analysis.

In particular in the context of location-dependent weighting, but also in general, additional individual reverberation times zusN are in particular added to the dataset. These are determined by a calibration measurement E in which microphones of the highest possible quality are used in order to obtain as good a measurement result as possible. Then measurements of the reverberation time for a given room are made in advance, and the data obtained in the process saved, e.g. on the server 12, in order to be available later to a user. In particular, this dispenses with any adaptation time for the hearing system 2 even when a room is entered for the first time. For instance, the calibration measurement E is performed in a theatre auditorium by the owner of the auditorium.

In one variant, after a defined time span or period has elapsed, individual reverberation times indN are forgotten and removed from the dataset D.

The method is not restricted to the configuration shown in FIG. 1. Indeed other configurations are also suitable although not shown. For example, the hearing aids 6 are connected directly to one another. In one variant, the hearing system 2 is connected directly to the server 12. In an alternative, no server 12 is used and instead any analysis is performed by the hearing system 2 itself and/or by the smartphone 10 or by another device.

The following is a summary list of reference numerals and the corresponding structure used in the above description of the invention:

2 hearing system
4 microphone
6 hearing aid

8 control unit
10 smartphone
12 server
allgN general reverberation time
D dataset
E calibration measurement
indN individual reverberation time
M microphone signal
Q sound source
S sound signal
S1 to S5 method steps
zusN additional individual reverberation time

The invention claimed is:

1. A method for operating a hearing system, the method comprising:

providing a binaural hearing system and a plurality of devices, said devices including at least two hearing aids of said binaural hearing system, and providing a plurality of microphones fitted in different said devices;

measuring a sound signal emanating from a sound source with the plurality of microphones;

each of the microphones detecting the sound signal and generating therefrom a microphone signal;

determining an individual reverberation time for each of the at least two microphone signals from the microphones of the hearing aids;

combining the individual reverberation times in a dataset and determining therefrom a general reverberation time; and adjusting an operating parameter of the hearing system based on the general reverberation time.

2. The method according to claim 1, which comprises:

combining the microphone signals into a raw dataset of raw data and saving the raw dataset externally in relation to the hearing system; and accessing the raw data with the hearing system and determining from the raw data first the individual reverberation time in each case and then a general reverberation type.

3. The method according to claim 1, wherein at least two of the microphones are arranged in different hearing systems.

4. The method according to claim 1, wherein one of the microphones is arranged in a hearing aid and another of the microphones is arranged in a smartphone.

5. The method according to claim 1, which comprises combining the individual reverberation times into a dataset on an external auxiliary device.

6. The method according to claim 5, which comprises, prior to the combining step, first determining the individual reverberation times of the microphone signals from a corresponding microphone by that device in which the microphone is fitted.

7. The method according to claim 5, which comprises using the auxiliary device to determine from the dataset the general reverberation time, and transmitting the general reverberation time to the hearing system.

8. The method according to claim 5, wherein the auxiliary device is a smartphone.

9. The method according to claim 5, wherein the auxiliary device is a server on which the dataset is saved.

10. The method according to claim 1, which comprises determining a general reverberation time by device-dependent weighting of the microphone signals or of individual reverberation times determined by the devices in which the microphones are fitted.

11. The method according to claim 1, which comprises determining a general reverberation time by user-dependent weighting of the microphone signals or of individual reverberation times determined by the devices in which the microphones are fitted.

12. The method according to claim 1, which comprises determining general reverberation time by time-dependent weighting of the microphone signals or of the individual reverberation times determined by the devices in which the microphones are fitted.

13. The method according to claim 1, which comprises providing the microphone signals or individual reverberation times determined by the devices in which the microphones are fitted with location information.

14. The method according to claim 13, which comprises saving the microphone signals or the individual reverberation times for a given location and using the saved microphone signals or individual reverberation times to determine the general reverberation time when a return is made later to the given location.

15. The method according to claim 1, which comprises using a calibration measurement to measure additional reverberation times, and adding the additional reverberation times to the dataset.

16. The method according to claim 1, which comprises providing the microphone signals or the individual reverberation times determined by the devices in which the microphones are fitted with a timestamp, and determining the general reverberation time by taking into account only those microphone signals or individual reverberation times having timestamps that date back no further than a predetermined maximum period.

17. A binaural hearing system configured for operation by the method according to claim 1, the system comprising:

two hearing aids each having at least one microphone for detecting a sound signal and generating a microphone signal therefrom; and a control unit configured to carry out the method according to claim 1 and to adjust the hearing system according to the general reverberation time.

* * * * *